US005551501A

United States Patent [19]

Davis et al.

[11] Patent Number: 5,551,501

[45] Date of Patent: Sep. 3, 1996

[54] SCREEN ASSEMBLY

[75] Inventors: Floyd C. Davis, Knoxville; Jesse T. Boring, Maryville; Charles W. Cowart; T. Glen Lowe, both of Knoxville, all of Tenn.

[73] Assignee: DCL, Inc., Wedowee, Ala.

[21] Appl. No.: 327,303

[22] Filed: Oct. 21, 1994

[51] Int. Cl.[6] ..... A47H 1/00

[52] U.S. Cl. ..... 160/87; 160/96

[58] Field of Search ..... 160/87, 90, 96, 160/97, 105; 49/63; 52/202, 207

[56] References Cited

U.S. PATENT DOCUMENTS

| | | | |
|---|---|---|---|
| 1,994,205 | 3/1935 | Yalch | 160/87 |
| 2,151,295 | 3/1939 | Hucke | 160/87 |
| 2,918,708 | 12/1959 | Sharp et al. | 20/35 |
| 3,136,396 | 6/1964 | Sullivan | 189/46 |
| 3,984,954 | 10/1976 | Takeda | 52/202 |
| 4,044,504 | 8/1977 | Nakada | 49/425 |
| 4,098,027 | 7/1978 | Crance | 49/504 |
| 4,483,009 | 11/1984 | Schmidt | 49/63 |
| 4,538,662 | 9/1985 | Tomita | 160/107 |

FOREIGN PATENT DOCUMENTS

| | | |
|---|---|---|
| 50111 | 6/1974 | Australia . |
| 1420069 | 1/1965 | France . |

*Primary Examiner*—Blair M. Johnson

*Attorney, Agent, or Firm*—Luedeka, Neely & Graham, P.C.

[57] ABSTRACT

The invention provides a screen door system for double-hung entry doors. The screen door system comprises an inner screen assembly containing a frame member carrying a screen member, an outer screen assembly containing a frame member carrying a screen member, inner and outer upper tracks for slidably guiding the inner and outer screen assemblies along the length of the tracks and for limiting lateral movement of the inner and outer screen assemblies as the screen assemblies move longitudinally along the tracks, and a lower sill having an inner guide rail for longitudinally guiding the inner screen assembly and an outer guide rail for longitudinally guiding the outer screen assembly.

12 Claims, 3 Drawing Sheets

SCREEN ASSEMBLY

FIELD OF THE INVENTION

The invention relates to a screen door assembly for entry doors.

BACKGROUND

Within recent years, the trend in building has been away from the sliding glass doors and more toward the use of single or double, double-hung entry doors for egress to the patio area of residential buildings. As with the sliding glass patio doors, there is sometimes associated with the single or double entry door a single screen door which will allow the door to be opened for fresh air circulation yet prevent insects or dirt from entering the building. The single screen doors may be hinged to swing open for egress from the building, or the single screen door may be affixed in a track for sliding to the opened or closed position. Even where double entry doors were used, there was typically only one screen door assembly.

An object of the invention therefore is to provide a multiple screen assembly system for a double entry door.

Another object of the invention is to provide a facile economic means for assembling a double screen door system.

Still another object of the invention is to provide a double screen door assembly which can readily be affixed adjacent an entry door frame.

Yet another object of the invention is to provide an upper double track assembly for use in slidably guiding a double screen door.

These and other object of the invention will become evident by the ensuing description and appended claims.

SUMMARY OF THE INVENTION

In one embodiment, the invention provides a screen system for entry doors. The screen system comprises an inner generally rectangular screen door having spaced apart elongate parallel upper and lower frame members of substantially equal length and an outer generally rectangular screen door having spaced apart elongate parallel upper and lower frame members of substantially equal length. Each of the screen door have a width corresponding generally to the length of its corresponding upper and lower frame members. The screen system also contains an upper screen door support member for attachment to a house adjacent a header of at least a double door exterior door system and a lower screen support member for attachment to a house adjacent a sill of the exterior door system in spaced apart relation to the upper screen door support member. A track guide system connects the inner and outer screen doors between the upper and lower screen door support members for translational movement in space-apart overlapping planes generally parallel to the screen doors in a direction substantially parallel to the length of the screen door support members.

In another embodiment, the invention provides an upper track for slidably guiding screen assemblies. The upper track comprises a first U-shaped channel having a first channel base member, a second U-shaped channel having a second channel base member, and a first side channel member common to and attached to the first and second U-shaped channels. The first and second base members of the U-shaped channels are offset relative to one another so that the first and second base members lie in different substantially parallel planes. Each U-shaped channel further contains a second side channel member on an opposing side of the channel base member from the first side channel member having a dimension sufficient to limit the lateral movement of the screen assemblies as the screen assemblies are moved in a direction substantially parallel to the U-shaped channels.

In yet another embodiment, the invention provides a screen system for double-hung entry doors. The screen system comprises an inner screen assembly containing a frame having upper and lower horizontal frame members and first and second vertical frame members carrying a screen; an outer screen assembly containing a frame having upper and lower horizontal frame members and first and second vertical frame members carrying a screen; and upper inner and outer longitudinal screen guides attached to a building adjacent the entry doors for slidably engaging a portion of the upper horizontal frame member of each of the inner and outer screen assemblies. Each of the inner and outer screen guides contain an elongate planar horizontal member having first and second edges, a first planar vertical member adjacent the first edge and a second planar vertical member adjacent the second edge wherein the second planar vertical member is common to both the inner and outer screen guides. Preferably, the elongate planar horizontal members lie is separate substantially parallel planes. The outer screen guide further contains an upstanding rigid elongate member substantially centered between the first and second planar vertical members for limiting the lateral movement of the outer screen assembly when slidably positioning the outer screen longitudinally along the outer guide. The screen system also contains a lower sill attached adjacent a sill of the double-hung entry doors having an inner guide rail for engaging the lower horizontal frame member of the inner screen assembly and for limiting lateral movement of the inner screen assembly and an outer guide rail for engaging the lower horizontal frame member of the outer screen assembly and for limiting lateral movement of the outer screen assembly when slidably adjusting the outer screen.

The invention therefore provides a facile economic means for providing a double screen assembly for double entry doors. Furthermore, the screen system of the invention has a configuration that reduces or avoids the interference between the movable screen and the handle of the entry door when slidably adjusting the screen.

SUMMARY OF THE DRAWINGS

Additional aspects of the invention will become known from the following detailed description of preferred embodiments when considered in conjunction with the accompanying drawings in which.

DETAILED DESCRIPTION OF THE INVENTION

Figure 1:
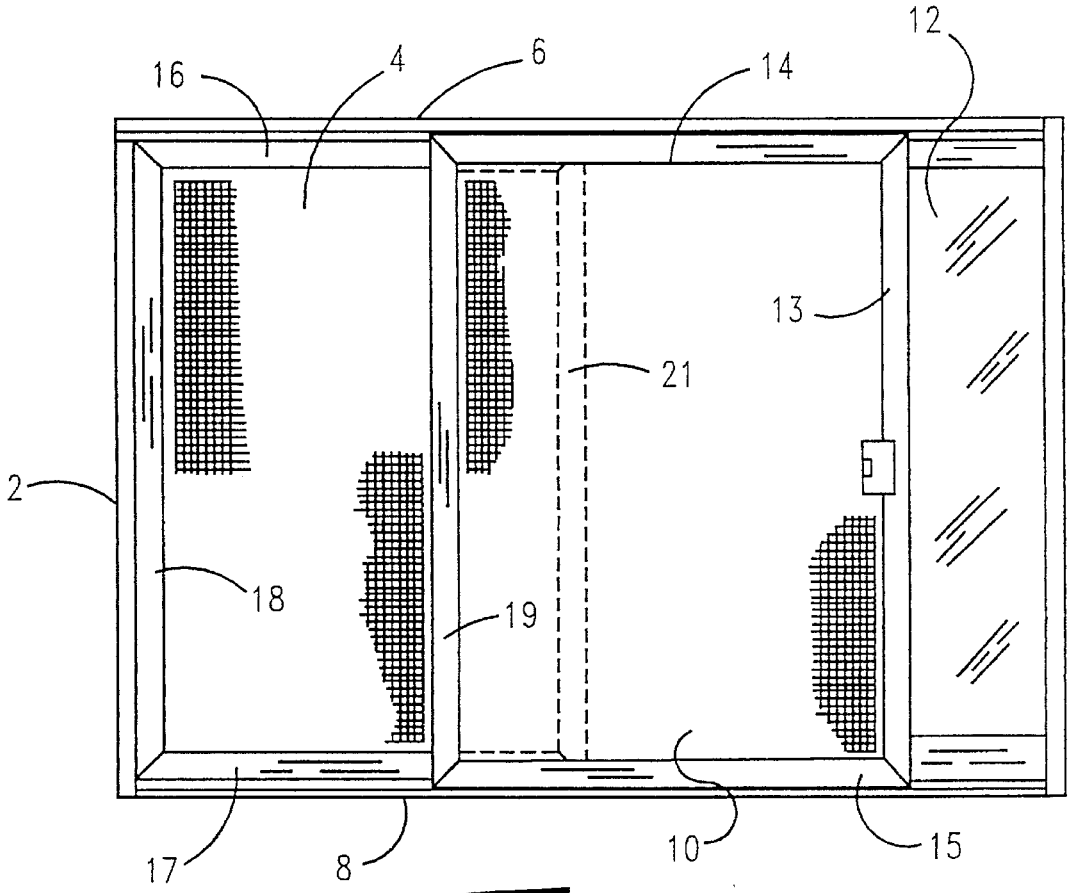
FIG. 1 is a elevational view, not to scale, of the double screen door assembly of the invention illustrating the overall arrangement of the double screen doors.

The overall arrangement of the double screen system of the invention is illustrated in FIG. 1. As illustrated in FIG. 1, the double screen system 2 of the invention comprises an inner screen assembly containing upper and lower horizontal frame members 16 and 17 first and second vertical frame members 18 and 21 carrying a screen member 4 and an outer screen assembly containing upper and lower horizontal frame members 14 and 15 and first and second vertical frame members 13 and 19 carrying a screen member 10. The outer screen assembly moves longitudinally along upper guide track 6 and lower guide rail 8. The entire screen assembly 2 is positioned relative to an entry door assembly 12 such that it is fixedly attached to the building within an outside perimeter of the entry door frame.

An important feature of the invention is the upper guide track 6 illustrated in FIGS. 2A through 2D. The track preferably contains two channels, an inner channel 20 and an outer channel 22 forming inner and outer upper guide tracks for slidably engaging upper horizontal frame members 14 and 16 of the inner and outer screen assemblies (FIG. 1). Each of the channels is formed by elongate planar horizontal members 32 and 34 and elongate planar vertical members 26, 28 and 30. It is preferred that planar vertical member 28 be common to inner and outer channels 20 and 22, however this is not required. In the alternative, an additional planar vertical member adjacent planar vertical member 28 can be provided to form channel 22. It is also preferred that the inner and outer channels be offset vertically relative to one another such that planar horizontal member 34 is offset a vertical distance V from planar horizontal member 32 and each planar horizontal members lie in substantially separate parallel planes. The vertical distance V is preferably between about 0.3 to about 1.0 inches (about 0.8 cm to about 2.54 cm). Most preferably, the vertical distance V is about 0.5 inches (about 1.3 cm). The vertical distance V is selected such that the upper guide track 6 will fit flush against the head jamb and brick mould of a typical entry door frame.

The overall width W of the upper guide track is preferably between about 1.3 and about 2 inches (about 3.3 cm and about 5 cm), most preferably about 1.4 inches (3.5 cm). The width of the individual channels 22 and 22 should be sufficient to allow for movement of the screen assemblies with a minimum amount of friction between the vertical members 26, 28 and 30 and the horizontal frame members 14 and 16 of the screen assemblies. The lengths of vertical members 26, 28 and 30 are not critical to the invention provided the length is sufficient to limit the lateral movement of the inner and outer screen assemblies particularly when adjusting the position of the screens in a direction substantially parallel to the length of the upper guide track 6.

In a particularly preferred embodiment, the upper guide track 6 will also contain an upright rigid elongate member 24 extending the length of the channel and substantially centered between planar vertical members 28 and 30 of the outer channel 22. It is preferred that at least the outer guide channel 22 contains upright rigid member 24, however, both inner and outer channels may contain upright rigid members 24. The height H of the upright rigid member 24 is preferably within the range of from about 0.2 to about inches (about 0.5 to about 1.0 cm). As further illustrated in FIG. 3, the upright rigid members 24 assist in guiding the inner and outer screen assemblies by engaging wheels 60 of the inner and outer screen assemblies to limit the lateral movement of the screen assemblies thereby reducing the amount of friction between upper horizontal frames 14 and 16 and vertical planar members 26, 28, and 30.

Figure 2A:
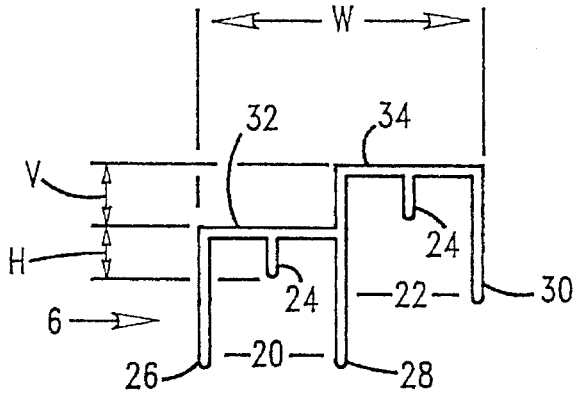
FIGS. 2A and 2B are cross-sectional views of typical dual upper channels of the invention for guiding the inner and outer screen assemblies.
Figure 2B:
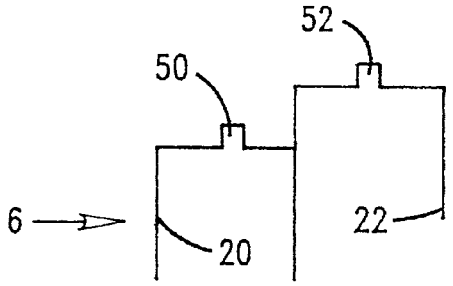

It will be recognized that the upper guide track may have other configurations which functionally limit the lateral movement of the screen assemblies while providing suitable means for slidably adjusting the screen assemblies. Accordingly, instead of upright members 24, channels 20 and 22 may have indentions 50 and 52 as illustrated in FIG. 2B. Indentions 50 and 52 may be wide enough to accept wheels attached to the upper horizontal frame members 14 and 16 of the inner and outer screen assemblies or may only be sufficiently wide to accept a relatively narrow metal guide pending from the upper horizontal frame members of the screen assemblies.

Figure 2D:
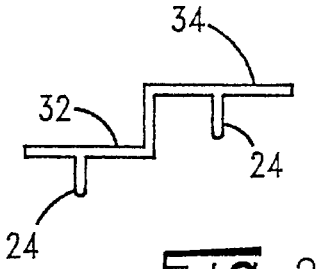
FIG. 2D is an cross-sectional view of an alternative dual upper screen guide.
Figure 2C:
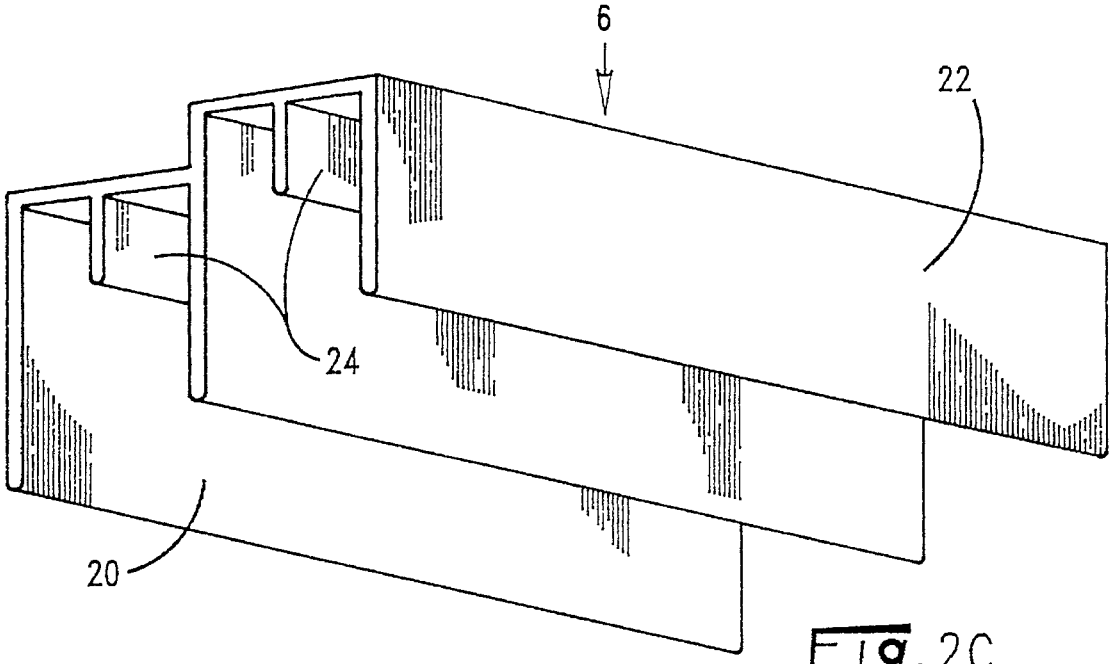
FIG. 2C is a perspective view of a dual upper guide channel of the invention.

FIG. 2D is yet another configuration for upper guide track 6. In this figure, the planar horizontal members 32 and 34 contain pendent upright members 24 extending the length of the tracks. These members 24 engage wheels 60 in the upper frame members 16 and 14 of the inner and outer screen assemblies to guide the screen assemblies during movement of the inner and outer screen assemblies in a direction substantially parallel to the length of upper guide track 6.

While channels 20 and 22 of the upper guide track 6 can be formed by any number of conventional means such as welding, tacking, riveting, bolting and the like, it is preferred that the guide track be a single extruded form containing inner and outer channels 20 and 22 and preferably upright member 24. The extruded track can be formed from any of the metals generally used in the building trade such as aluminum, mild steel, galvanized steel, and the like. In the alternative, the upper guide track may be molded or extruded from a macromolecular plastic material, such as a polyolefin, high impact polyolefin, polyamides, phenolics, and the like.

Figure 3:
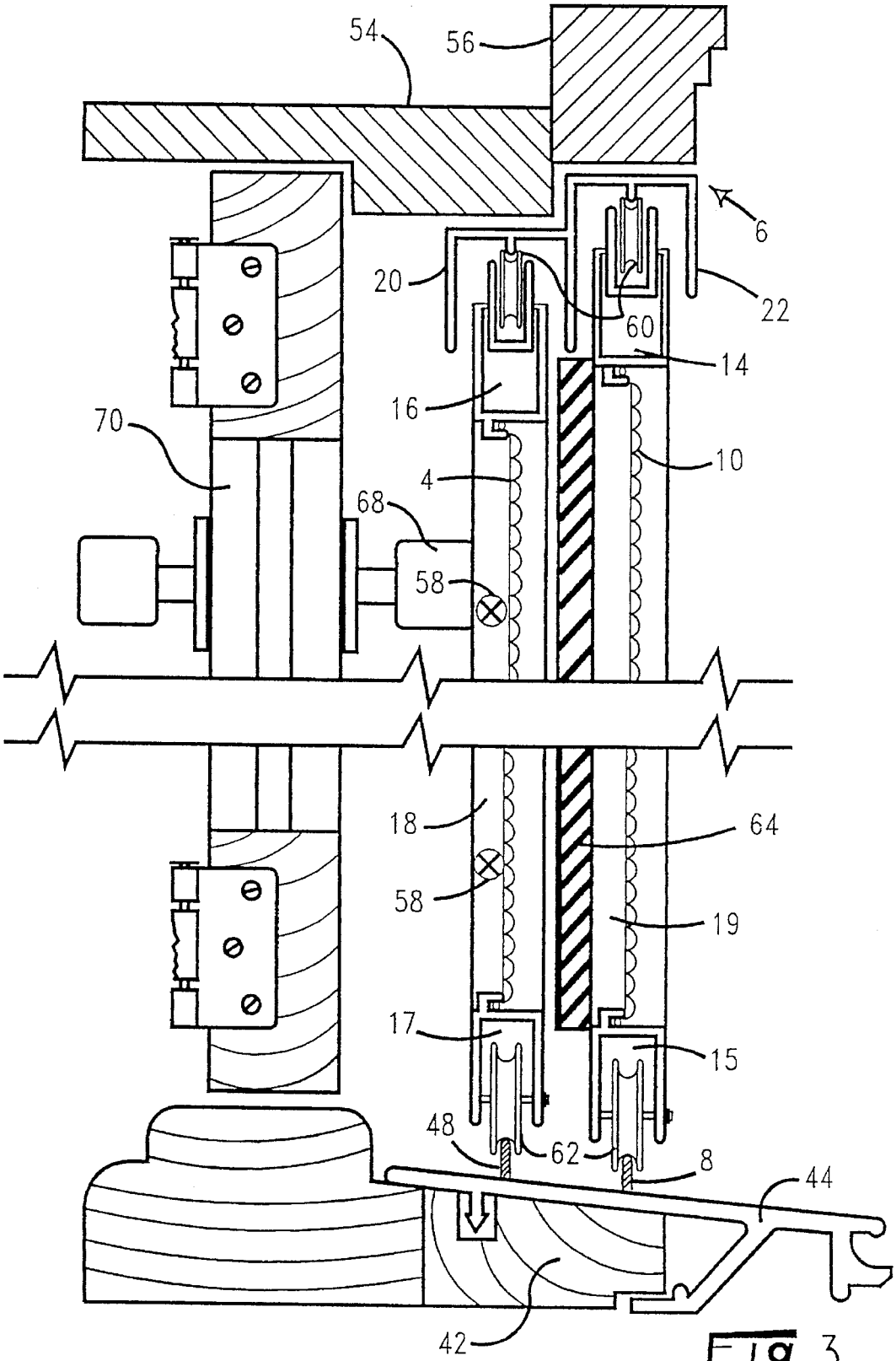
FIG. 3 is a partial vertical sectional view illustrating the relative positions of the inner and outer screen assemblies and a double entry door.

FIG. 3 is a cross-sectional partial elevational view of the double screen assembly of the invention. The screen assembly may be affixed to a double door frame by attaching the upper guide track 6 to the head jamb 54 and brick mould 56 of a door frame and attaching a lower sill 44 to the sill area 42 of the entry door passage way. The screen assemblies are then positioned to engage the upper guide track 6 and lower sill 44 of the double screen assembly.

In order to slidably adjust the inner and outer screen assemblies, each screen assembly preferably contains a pair of longitudinally spaced wheels 60 mounted in the upper horizontal frame members 14 and 16 and longitudinally spaced wheels 62 mounted in the lower horizontal frame members 15 and 17. Wheels 60 are guided within channels 20 and 22 preferably by upright rigid members 24 (FIG. 2A) so as to limit the lateral movement of the screen assemblies particularly where friction between the horizontal frame members 14 and 16 and the vertical members 26, 28 and 30 of channels 20 and 22 (FIG. 2) might occur.

In a particularly preferred embodiment, first vertical frame member 19 of the outer screen assembly contains a pendant resilient elongate member 64 projecting inwardly toward the outer screen assembly. Resilient elongate member 64 is useful for wiping the outer surface of the inner screen 4 (FIG. 1) when slidably adjusting the outer screen assembly. The resilient elongate member 64 may also seal between adjacent second vertical frame members 21 and 19 (FIG. 1) of the inner and outer screen assemblies which overlap each other when the screens are in their fully closed position relative to the entry door. In the alternative, the resilient member 64 may be pendant outwardly from the second vertical frame member 21 (FIG. 1) of the inner screen assembly so as to wipe an inner surface of outer screen 10. Likewise, the resilient elongate member 60 attached to the inner screen assembly may seal between adjacent vertical frame members 21 and 19 (FIG. 1) of the inner and outer screen assemblies which overlap each other when the screens are in their fully closed position relative to the entry door. While not preferred, resilient elongate members 64 may be affixed to the second vertical frame members (19 and 21) of both the inner and outer screen assemblies.

In another particularly preferred embodiment, only the outer screen assembly is slidably adjustable. Accordingly, the inner screen assembly may be affixed to the entry door frame by holding screws 58 or any other well known attachment means.

Figure 4:
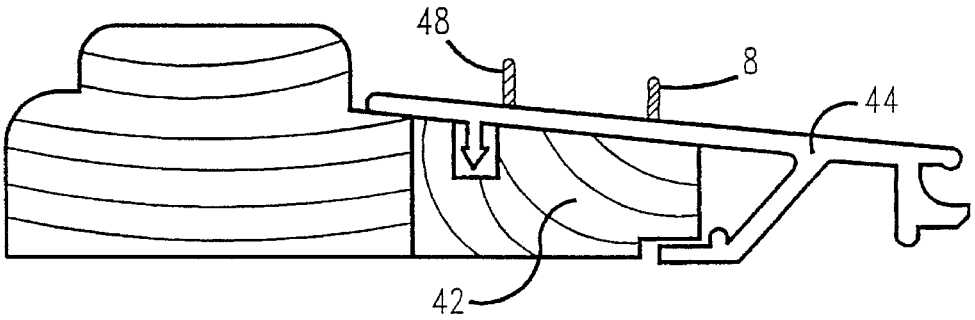
FIG. 4 is a cross-sectional view of a typical sill assembly for the double screen system.

FIG. 4 illustrates the features of a typical sill assembly 44 for use with the double screen system of this invention. The sill 44 is affixed within the sill area 42 of the entry door and contains inner guide rail 48 and outer guide rail 8 for longitudinally guiding the inner and outer screen assemblies. The guide rails are positioned relative to one another so that they engage the lower horizontal frame members of the inner and outer screen assemblies and hold the screen assemblies in substantially vertical orientations when the upper horizontal frame members 14 and 16 (FIG. 1) are engaged by upper track 6. Guide rails 8 and 48 also provide for longitudinal sliding movement of inner and outer screen assemblies whereby the lateral movement of the screen assemblies is limited. As illustrated in FIG. 3, the upper guide track and lower sill provide for movement of the outer screen assembly even where the door handle 68 of an entry door 70 protrudes a distance that prevents full movement of the inner screen assembly. This advantage is achieved with the use of the double screen assembly, the resilient elongate member for sealing between adjacent vertical frame members, and the configuration of the upper track and lower guide rail. Having an upper guide track and a lower guide rail that allow the inner and outer screen assemblies to be positioned within a entry door frame so that the inner and outer screen assemblies are slidably positioned near one another, provides a narrow space between the overlapping vertical frame members of the screen assemblies that can be sealed with a resilient elongate sealing member. Hence the screen assemblies need not be positioned in close proximity to the entry doors 70 since a seal need not be effected between the entry door or door frame and the screen assemblies.

While the foregoing description relates in general to double screens and double entry door, the invention can readily be adapted for use with more than two screens and more than two entry doors. Furthermore, while there is no particular commercial advantage to the use of the screen system as described with a single entry door, such use is also contemplated by the invention.

Having described and illustrated the invention in its preferred embodiments, it will be recognized that variations of the present invention by those skilled in the art are within the spirit and scope of the appended claims.

What is claimed is:

1. A screen system for double-hung entry doors comprising an inner screen assembly containing a frame having upper and lower horizontal frame members and first and second vertical frame members carrying a screen; an outer screen assembly containing a frame having upper and lower horizontal frame members and first and second vertical frame members carrying a screen; upper inner and outer longitudinal screen guides attached to a building adjacent the entry doors for slidably engaging a portion of the upper horizontal frame members of each of said inner and outer screen assemblies, each of said inner and outer screen guides containing an elongate planar horizontal member having first and second edges, a first planar vertical member adjacent said first edge and a second planar vertical member adjacent said second edge whereby the second planar vertical member is common to both the inner and outer screen guides, wherein said elongate planar horizontal members lie in separate substantially parallel planes and wherein said outer screen guide further contains an upstanding rigid elongate member substantially centered between said first and second planar vertical members for limiting the lateral movement of said outer screen assembly when slidably positioning said outer screen longitudinally along said outer guide; and a lower sill attached adjacent a sill of the entry doors, said lower sill having an inner guide rail for engaging said lower horizontal frame member of said inner screen assembly and for limiting lateral movement of said inner screen assembly and an outer guide rail for slidably guiding said lower horizontal frame member of said outer screen assembly and for limiting lateral movement of said outer screen assembly when slidably adjusting said outer screen.

2. The screen system of claim 1 wherein said screen system is fixedly positioned relative to a door frame and wherein the first vertical frame member of said inner screen assembly is fixedly attached to a frame member of said door frame.

3. The screen system of claim 1 wherein the outer screen assembly contains an elongate resilient member attached to the second vertical frame member, said resilient member being positioned on said second frame member between said inner and outer screen assemblies for wiping an outer surface of said inner screen assembly and for sealing between adjacent overlapping vertical frame members of each inner and outer screen assembly.

4. The screen system of claim 3 wherein the inner screen assembly contains an elongate resilient member attached to the second vertical frame member, said resilient member being positioned on said frame member between said inner and outer screen assemblies for wiping an inner surface of said outer screen assembly and for sealing between adjacent vertical overlapping frame members of each inner and outer screen assembly.

5. The screen system of claim 1 wherein the inner screen assembly contains a resilient member attached to a vertical frame member, said resilient member being positioned on said frame member between said inner and outer screen assemblies for wiping an inner surface of said outer screen assembly and for sealing between adjacent vertical overlapping frame members of each inner and outer screen assembly.

6. The screen system of claim 1 wherein said outer screen assembly is larger than said inner screen assembly.

7. The screen system of claim 1 wherein said outer screen assembly contains a pair of longitudinally spaced wheels mounted in the upper horizontal frame member for slidably engaging said upper outer longitudinal screen guide and a pair of longitudinally spaced wheels mounted in the lower horizontal frame member of said outer screen assembly for slidably engaging said outer guide rail of the lower sill.

8. A screen door assembly which comprises an inner generally rectangular screen door having spaced apart elongate parallel upper and lower frame members of substantially equal length and an outer generally rectangular screen door having spaced apart elongate parallel upper and lower frame members of substantially equal length, each of said screen doors having a width corresponding generally to the length of its corresponding upper and lower frame members, an upper screen door support member for attachment to a building adjacent the header of an at least a double door exterior door system, a lower screen door support member for attachment to the building adjacent a sill of the exterior door system in spaced relation to the upper screen door support member, and a track guide system for connecting the inner and outer screen doors between the upper and lower screen door support members for translational movement in spaced apart overlapping planes generally parallel to the screen doors in a direction substantially parallel to the length of the screen door support members.

9. The double screen assembly of claim 8 wherein the outer screen door contains a pendant resilient elongate member positioned along a vertical edge portion of said door so as to project inwardly toward said inner screen door for wiping an outer surface of said inner screen door when translationally moving said outer screen door.

10. The double screen assembly of claim 9 wherein the inner screen door contains a pendant resilient elongate sealing member positioned along a vertical edge portion of said door so as to project outwardly toward said outer screen door for sealing between adjacent vertical edge portions of said inner and outer screen door.

11. The double screen assembly of claim 8 wherein the inner screen door contains a pendant resilient elongate member positioned along a vertical edge portion of said door so as to project outwardly toward said outer screen door for wiping an inner surface of said outer screen door when translationally moving said outer screen door.

12. The double screen assembly of claim 8 wherein said upper frame member contains an inner and outer track guide for guiding the inner and outer screen doors wherein the inner and outer track guides are offset vertically relative to one another for attachment to a head jamb and brick mould of the double door unit.

* * * * *

UNITED STATES PATENT AND TRADEMARK OFFICE

CERTIFICATE OF CORRECTION

PATENT NO. : 5,551,501

DATED : September 3, 1996

INVENTOR(S) : Floyd C. Davis, et al.

It is certified that error appears in the above-indentified patent and that said Letters Patent is hereby corrected as shown below:

Column 3, line 66, after "about" insert -- 0.4 --.

Column 4, line 65, delete "64" and insert -- 60 --.

Signed and Sealed this

Eighteenth Day of February, 1997

*Attest:*

*Attesting Officer*

BRUCE LEHMAN

*Commissioner of Patents and Trademarks*